US005911859A

United States Patent [19]

Greaney et al.

[11] Patent Number: 5,911,859

[45] Date of Patent: Jun. 15, 1999

[54] THREE-DIMENSIONAL ELECTRODE (LAW464)

[75] Inventors: Mark Alan Greaney, Upper Black Eddy, Pa.; Paul James Polini, Rahway, N.J.

[73] Assignee: Exxon Research and Engineering Co., Florham Park, N.J.

[21] Appl. No.: 08/900,390

[22] Filed: Jul. 15, 1997

[51] Int. Cl.[6] ..... C25B 11/00

[52] U.S. Cl. ..... 204/280; 204/288

[58] Field of Search ..... 204/280, 288

[56] References Cited

U.S. PATENT DOCUMENTS

| | | | |
|---|---|---|---|
| 3,457,152 | 7/1969 | Maloney, Jr. et al. | 204/131 |
| 3,897,318 | 7/1975 | Heckle et al. | 204/73 R |
| 4,203,808 | 5/1980 | Campbell et al. | 204/23 |

OTHER PUBLICATIONS

Brown et al, Studies of three–dimensional electrodes in the FM01–LC laboratory electrolyser, J. Appl. Electrochem, 24, pp. 95–106 (1994). No month available.

*Primary Examiner*—Bruce F. Bell
*Attorney, Agent, or Firm*—Linda M. Scuorzo

[57] ABSTRACT

The invention provides a working electrode for use in an undivided electrochemical cell that is composed of at least one three dimensional accordion pleated sheet member having an open surface area of from zero to 50%. Typically suitable materials include metal mesh and woven fibers. The invention also includes an undivided electrochemical cell, containing the novel working electrode. Finally, the invention includes a method for electrochemically treating a metals-containing hydrocarbon stream in an undivided electrochemical cell by contacting a metals containing hydrocarbon stream with the novel pleated electrode. The invention has broad applicability for treating starting materials that produce electrochemically reversible (redox active) intermediates.

9 Claims, 6 Drawing Sheets

THREE-DIMENSIONAL ELECTRODE (LAW464)

BACKGROUND OF THE INVENTION

Electrochemical cell designs are classified as undivided when the solution being electrolyzed freely flows past the anode and the cathode or as divided when the cathode and the anode are separated from each other by an ion-permeable membrane which inhibits mixing of the solution which contacts the cathode (catholyte) and that which contacts the anode (anolyte). Though simple in concept, in practice divided cells suffer disadvantages relative to undivided cells. The first is the necessity of a dividing ion-permeable membrane, which increases the total cell voltage, introduces stability, poisoning, pressure differential and temperature limitations that can require periodic dismantling of the cell in commercial practice. In addition, the two separate solutions to be recirculated increase the required pumping, tankage and piping requirements for a given process. However, the divided cell is typically necessary in situations in which the desired chemistry at the working electrode is adversely affected by contact with the counterelectrode, or by reaction products generated at the counterelectrode. For example, if a reduction at the cathode is electrochemically reversible, the electrons added at the cathode would be removed at the anode, leading to an unproductive redox cycle. Similarly, if a species generated at the cathode is oxygen-sensitive, and oxygen is evolved at the anode, contact with the anode product, oxygen, would be detrimental to the cathodic reduction process.

It would be highly desirable to have a process and cell configuration that can provide the performance benefits of a divided cell configuration in an undivided cell for application to such reaction systems. Applicants invention address this need.

SUMMARY OF THE INVENTION

The present invention provides for:

A first embodiment that is a working electrode for use in an undivided electrochemical cell, comprising: a three dimensional accordion pleated plate member having an open area of from zero to 50%.

A second embodiment that is an undivided electrochemical cell, comprising: a counterelectrode; a current feeding means; a working electrode composed of at least one three dimensional accordion-folded sheet member having an open surface area of from zero to 50%, said working electrode connected to the current feeding means, and disposed between the counterelectrode and the current feeding means; means for introducing circulating an electrolyte containing the starting material to be treated through the cell in a direction substantially parallel to the direction of the folds in the sheet member; an insulating housing surrounding the counterelectrode, current feeding means and working electrode and providing restriction of electrolyte flow perpendicular to the folds in the sheet member.

A third embodiment that is a method for electrochemically treating a metals-containing hydrocarbon stream in an undivided electrochemical cell, comprising: contacting a metals containing hydrocarbon stream with a working electrode composed of at least one three dimensional accordion-folded sheet member having an open surface area of from zero to 50%.

The present invention may suitably comprise, consist or consist essentially of the elements described herein.

DETAILED DESCRIPTION OF THE INVENTION

The present invention provides for an enhanced undivided electrochemical cell configuration, for a novel working electrode configuration used therein and for a method of treating reactants that produce intermediates or species that are electrochemically reversible or otherwise subject to undesirable reactions in the presence of the oppositely charged electrode (i.e., counter-electrode).

One embodiment of the invention provides for an electrode composed of a three dimensional accordion or Z folded or pleated member. It may be solid or porous, i.e., a porosity of 0–50% open area. Typically it is composed of metal, however, this does not preclude the use of other materials, e.g., carbon, provided that they may be fabricated into the required shape and are otherwise suitable as a working electrode in the particular process.

The invention also provides for an electrochemical reactor or cell incorporating the novel three dimensional electrode. The reactor or cell has an electrolyte compartment or chamber for introduction of the electrolyte medium containing the material to be electrochemically treated, a means for introducing current to the cell and a means for flowing electrolyte through the cell. The electrolyte chamber is defined by an upper portion which is the current feeding or introducing means, preferably a plate, and a lower portion parallel to the upper portion which is a counterelectrode to the three dimensional pleated, or Z shaped working electrode and nonconductive flow distributors and spacers define the sides the chamber. The three dimensional pleated, electrode is disposed in the electrolyte compartment and connected to the current feeding means. The electrolyte in the electrolyte compartment is in contact with the three dimensional pleated working electrode. The pleated sheets are typically compressed to form a three dimensional working electrode. The number of sheets and thickness of each pleat is influenced by reactor and process parameters and may be selected by one skilled in the art.

Figure 1A:
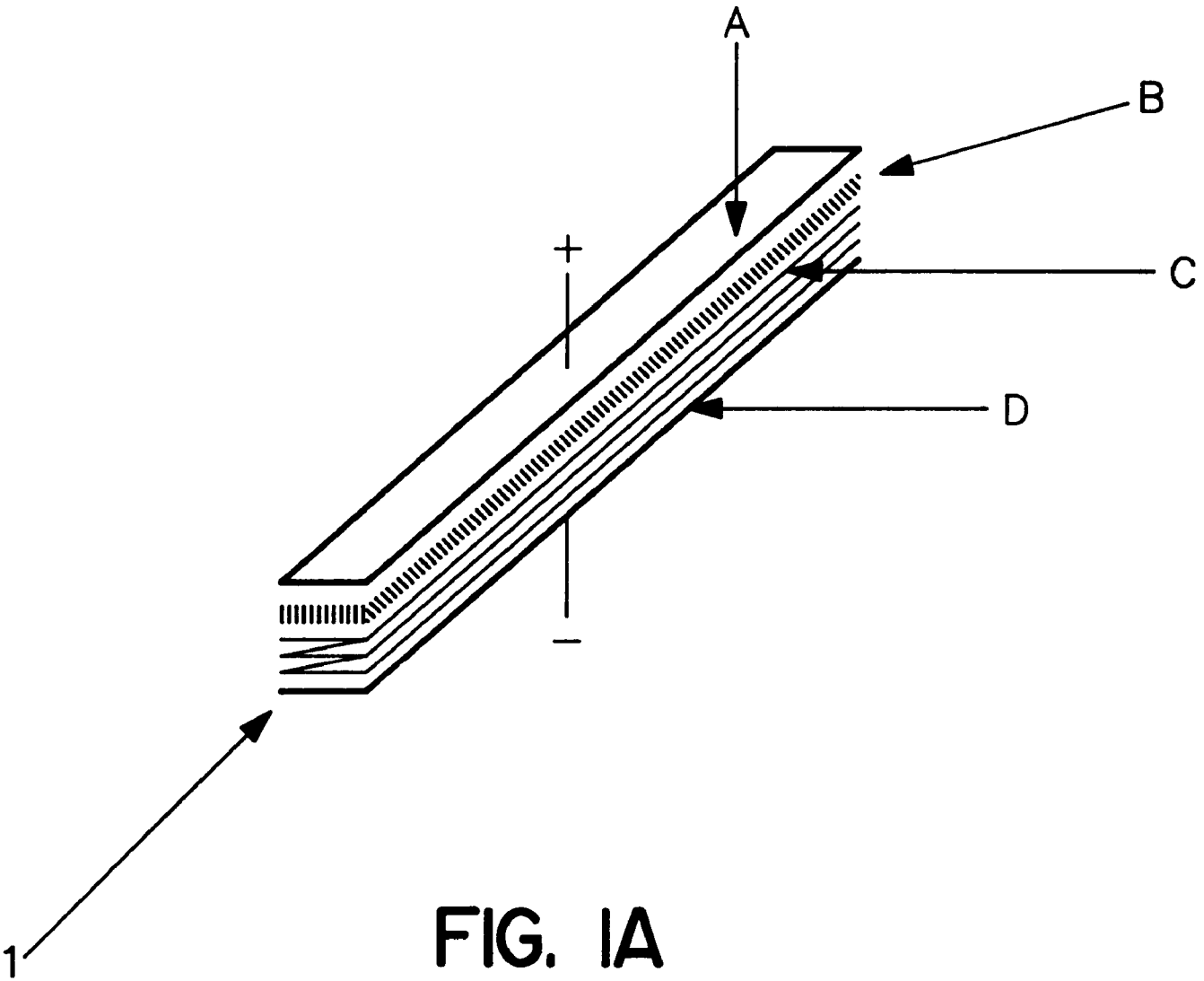
FIG. 1A illustrates an "accordion or Z pleated", three dimensional electrode of the present invention.

More particularly, the undivided reactor or cell of the present invention comprises at least one pair of oppositely polarized electrodes forming an electrode pair containing a first electrode that is a three dimensional electrode composed of at least one accordion or Z-pleated sheet or plate member. In all cases it is required that the porosity of the plate is from zero to preferably less than 50% open area. Desirably plates having smaller open area percent and uniform distribution of open area, where present, are preferred. When the working electrode is porous (i.e., open area is greater than zero to less than 50%), it may be any type of porous plate such as expanded mesh, perforated or punched holes or woven wire cloth, fibers or filaments. The plate is preferably a thin plate as thicker plates tend to increase electrolyzer volume. The dimensions of the plate may be chosen by one skilled in the art based on overall cell configuration and the electrochemical reaction to be carried out. The dimensions of the plate (e.g., thickness, length, diameter) may be varied in view of the overall cell configuration. Typically the pleats or folds are such that the plate has a length greater than its width, but other geometries such as pleated squares and pleated circular discs are not precluded provided that in each case the overall direction flow of electrolyte is parallel to the pleats/folds in the plate (such direction is represented by the arrow (1) in FIG. 1A) and crosswise flow (i.e., perpendicular to the direction of the arrow as represented in FIG. 1A) as discussed below is minimized. The electrode materials are suitably chosen in view of the electrochemical process to be carried out and in depending on whether the electrode is to function as the cathode or the anode.

The reactor components may be purchased or may be constructed by methods and using materials known in the art to be suitable for the electrochemical reaction to be carried out (e.g., Brown, C. J.; Pletcher, D.; Walsh, F. C.; Hammond, J. K.; Robinson, D., *Journal of Applied Electrochemistry,* 1994, 24, 95–106, U.S. Pat. No. 3,457,152). By way of example, a suitable cell would be the SMO1, available from ICI Industries, UK. Materials used for forming the three dimensional folded of pleated electrode may be purchased commercially. Fabrication into pleated members may be accomplished using known techniques.

Figure 1B:
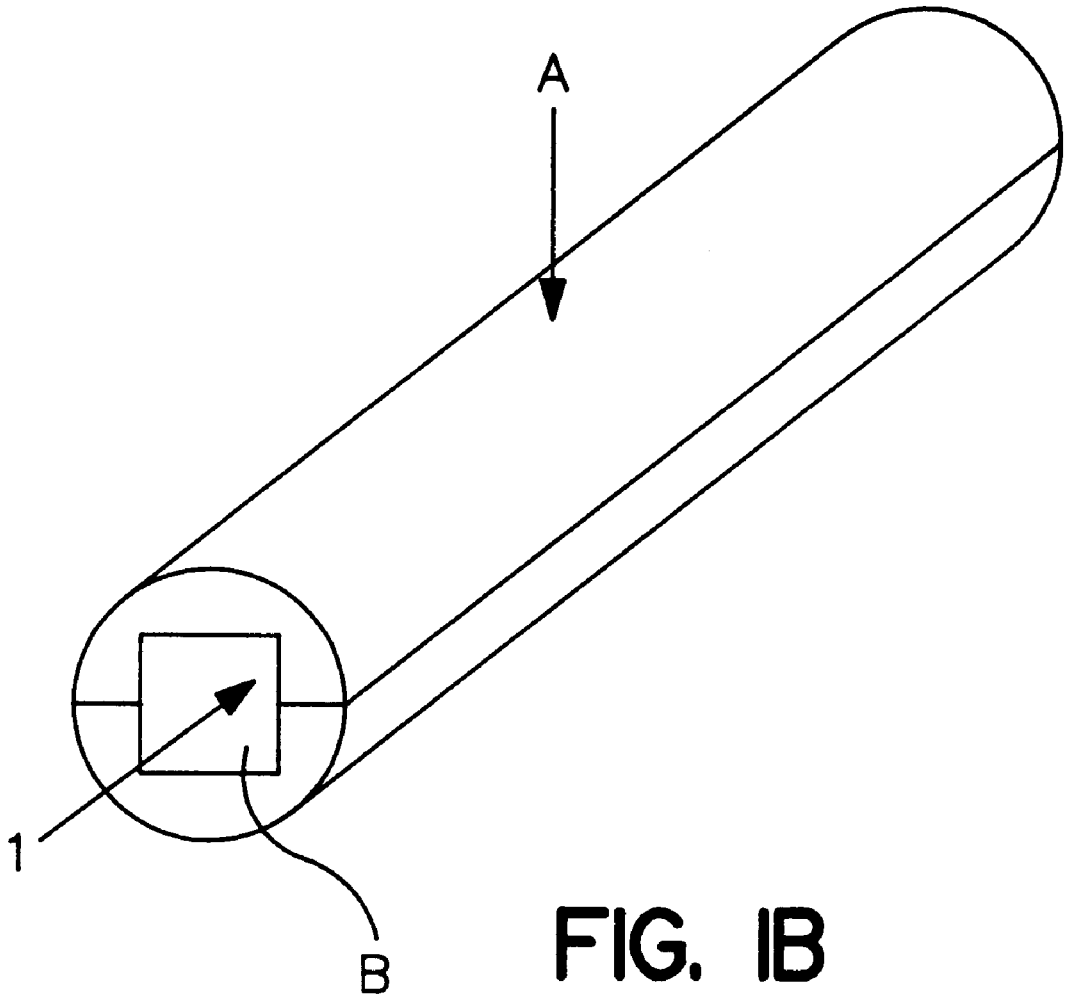
FIG. 1B illustrates a cross-sectional view of an insulating means for housing the accordion or Z pleated electrode of FIG. 1A.
Figure 5A:
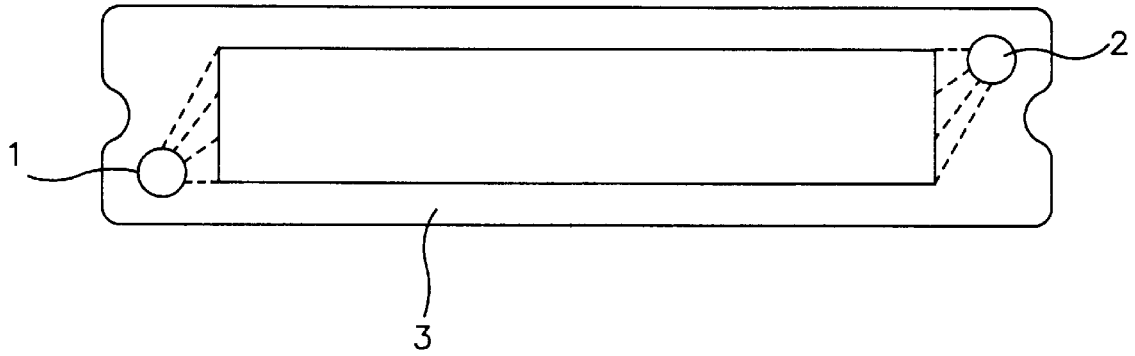
FIG. 5A illustrates a top view of the electrode stack configuration containing the accordion or Z pleated, three dimensional working electrode in a commercially available cell.
Figure 5B:
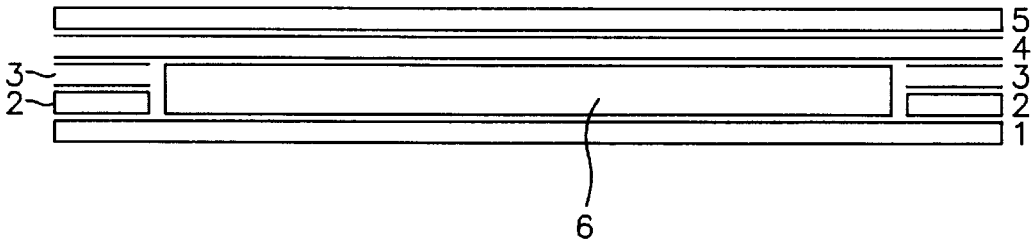
FIG. 5B is a side view of the electrode stack configuration of FIG. 5A.

The three dimensional electrode parallel to and separated from a counterelectrode, and a current feeder is connected to and used for passing current from the electrode functioning as the cathode to the electrode functioning as the anode. Flow distributing means introduce and circulate electrolyte containing the starting material to be treated through the cell in a net or bulk direction of flow parallel to the folds or pleats in the three dimensional electrode and for circulate the electrolyte through the cell in contact with the electrodes. Disposed between and substantially parallel to the direction of the pleats of the working electrode and to the counterelectrode plate are non-reactive spacers to prevent direct contact of the anode and cathode, e.g., shorting. Positioning of spacers may be typically made as known in the art. Preferably the counterelectrode and current feeding means are plate structures and are parallel to each other. The flow distributing means provides an inlet for introducing the electrolyte containing the starting material to be treated to and an outlet for removing it from the cell and is used to minimize contact of electrolyte with the counterelectrode and maximize flow of electrolyte through the pleats or folds of the working electrode. The general direction of flow through the cell is substantially parallel to the folds or pleats in the three dimensional working electrode. The presence of pores in the accordion folded plates of the working electrode stack may provide for more even potential distribution through the stack. Thus although a portion of the electrolyte flows past the counterelectrode (in order to complete the electric circuit) substantially all of the flow is through the three dimensional pleated working electrode, to decrease or minimize reversibility of the redox active intermediate species or undesirable side reactions occurring at the counterelectrode. FIGS. 1A, 5A and 5B illustrate the configuration of the novel working electrode. FIG. 1B illustrates the insulating means, e.g., cell jacket or housing in which the electrode stack is housed to minimize crossflow of the electrolyte around the novel working electrode.

The benefit of the three dimensional pleated electrode of the present invention is derived from its unique structure rather than from the particular materials of which it is composed. Thus the novel electrode is suitable for use in any electrochemical reaction that produces intermediates or species the are electrochemically reversible or that otherwise would not be converted to desired end products if contacted with the counterelectrode. The three dimensional pleated working electrode of the present invention thus provides the benefits of a divided electrochemical cell in an undivided cell configuration.

The pleated electrode configuration of the present invention, and the path of the electrolyte through it, is distinguishable from art recognized three dimensional electrodes such as screens and honeycomb-type structures in which the pores or channels in the electrode plates are regularly defined and oriented, and flow of the electrolyte is not constrained by the structure of the electrode to decrease or minimize flow around the three dimensional electrode and contact of the electrolyte with the counterelectrode (i.e., crossflow) and flowaround. The stacked mesh screens, metal foams, stacked nets and stacked grids typically employed in the design of art recognized three dimensional electrodes typically are configured in patterns that produce a flow through and around the electrode, and may be random or regularly oriented. Desirably the working electrode is configured to provide enhanced contact of the electrolyte and starting material to be treated with the working electrode while minimizing contact of the starting material and redox active intermediates with the counter electrode. This effectively maintains separation of the novel electrode and counterelectrode despite circulation of the electrolyte, so that in Applicants' system the solution undergoing reduction at the working electrode has substantially decreased contact or exposure to the counterelectrode. Typically, the three dimensional electrode employed in this invention permits a substantial amount, typically at least 90% of electrolyte volume of the electrolyte to contact the working electrode, and more importantly, limits contact with the counterelectrode to a minor amount sufficient to support current flow through the cell, typically of about 10% or less. Applicants' cell configuration and novel electrode structure provide flow around and crosswise flow restriction and, i.e., reduction of electrolyte flow perpendicular to the folds or pleats of the working electrode and around the working electrode. Desirably this can lead to further enhancement of the rates of the desired reactions.

Beneficially, the electrode configuration described herein has broad applicability to any chemical conversion in which reactive electrochemical intermediates are produced that would undergo reversible reaction in the presence of the counterelectrode.

The electrolyte is suitably a conducting solution containing the starting materials to be treated. The current to be applied will vary based on the cell configuration and materials to be treated. These may be chosen by one skilled in the art based on known factors.

The material of which the novel working electrode is composed is chosen for its suitability to the particular reaction. Typically metals and metal alloys are used due to the relative ease of fabrication, however, use of carbon and other materials are acceptable provided that they can be fabricated in to the accordion pleated shape required herein. For example, in the electrochemical treatment of hydrocarbon streams to decrease metals content, e.g., to decrease the nickel and vanadium content of organic species such as metalloporphyrins, the working electrode is a cathode and the metal is suitably zinc, cadmium, lead, tin and alloys thereof, and carbon, and is fabricated into an accordion or Z pleated thin sheet, expanded mesh or woven wire cloth. Expanded metal mesh is commercially available, e.g., from Exmet Corporation, and other materials are similarly commercially available.

One embodiment of the invention is illustrated in FIG. 1A The electrode stack is composed of anode (A), spacers (B) between anode (A) and three dimensional accordion pleated cathode (C). Connected to cathode (C) is feeder plate (D). The direction of flow of electrolyte and starting material to be treated (1) is parallel to the folds in the pleated cathode as indicated by arrow.

FIG. 1B illustrates a cross-sectional view of an insulating means (A) such as a jacket/gasket, into which the electrode stock of FIG. 1A (B) is inserted to provide cross-flow restriction of electrolyte flow around the accordion pleated cathode. Direction of Electrolyte (1) flow is indicated by the arrow. Electrolyte (1) in this Figure corresponds to (1) in FIG. 1A.

Figure 2:
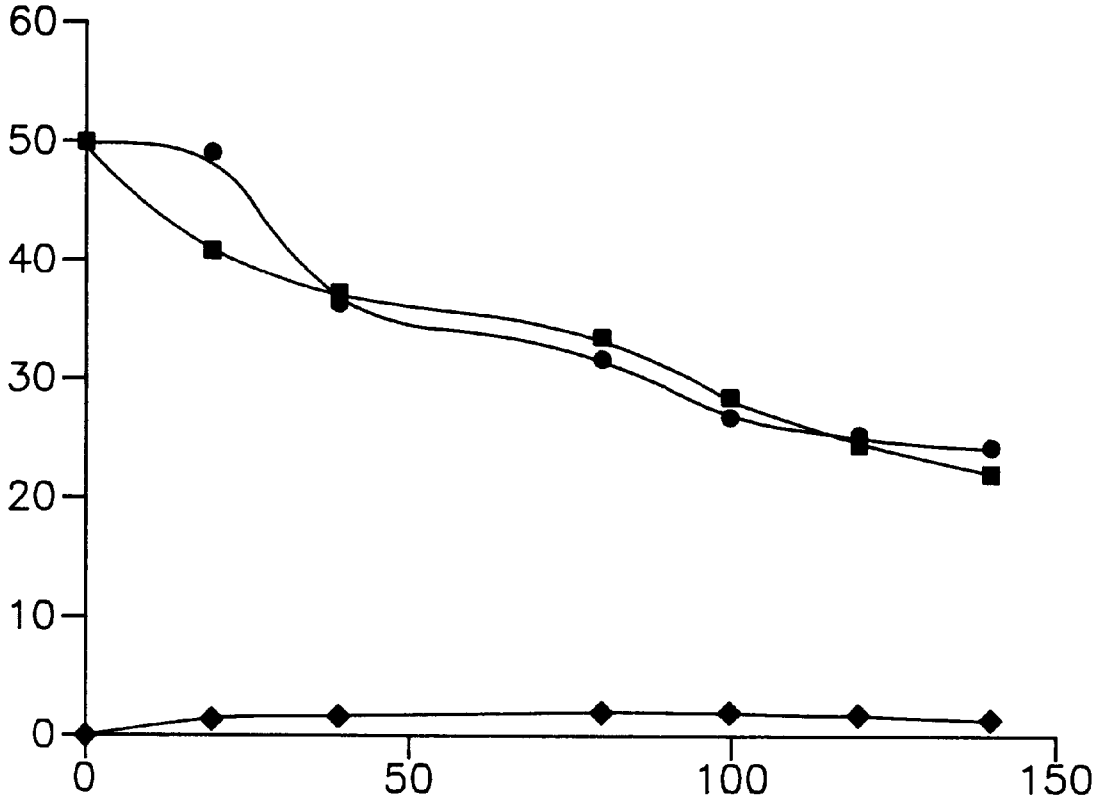
FIG. 2 is a plot of total vanadium concentration and the concentration of two vanadium-containing species in ppm (y-axis) vs. time (x-axis) for a conventional undivided cell.
Figure 3:
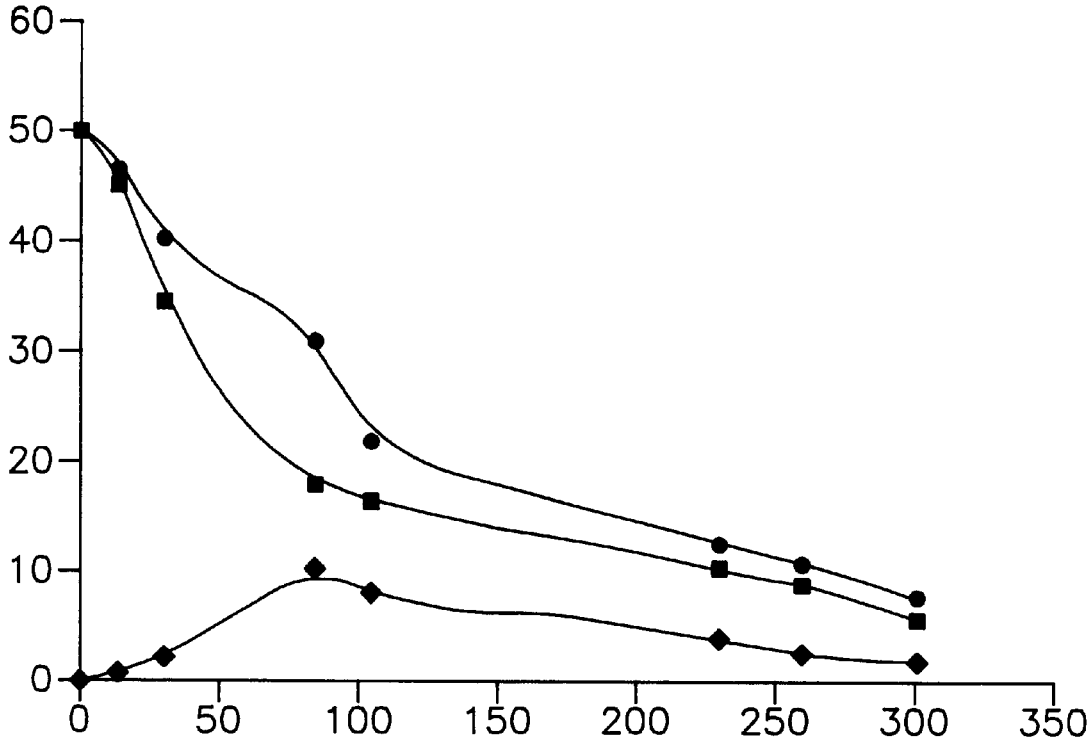
FIG. 3 is a plot of total vanadium concentration and the concentration of two vanadium-containing species in ppm (y-axis) vs. time (x-axis) for a conventional divided cell.
Figure 4:
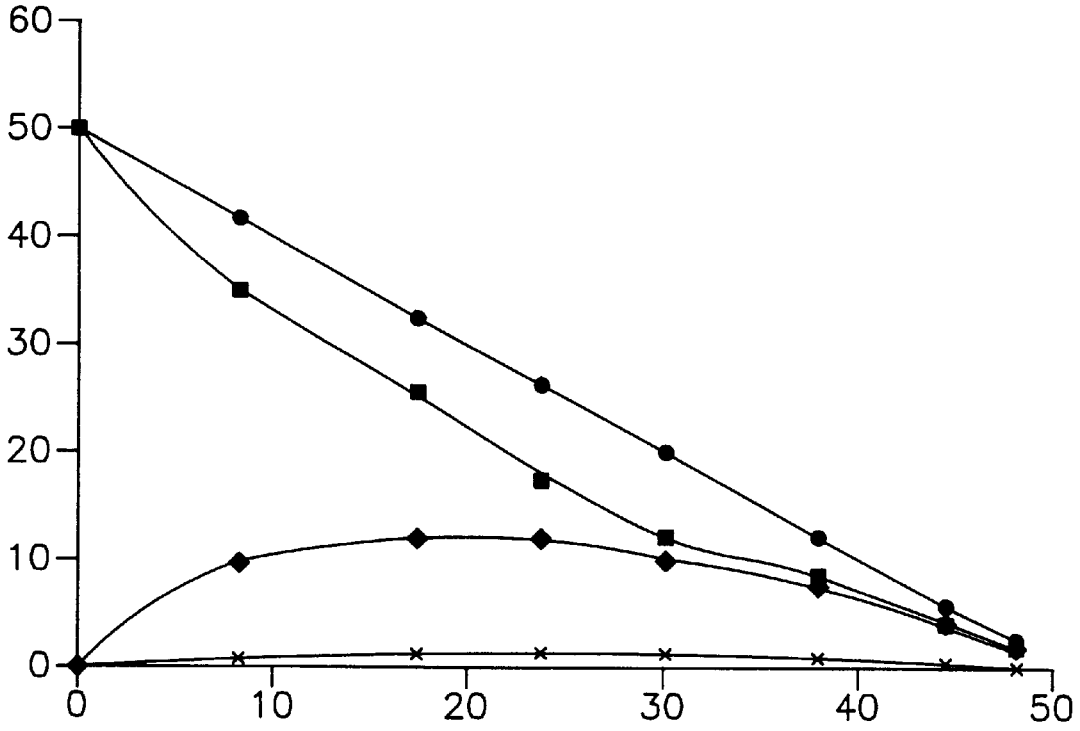
FIG. 4 is a plot of total vanadium concentration and the concentration of three vanadium containing species in ppm (y-axis) vs. time (x-axis) in an undivided cell in the present invention.

In FIGS. 2–3 are presented plots of comparative data to demonstrate the present invention demonstrated in FIG. 4. In FIGS. 2–4 filled circles represent total vanadium concentration in the organic phase as measured by electron spin reasonance (ESR); filled squares represent vanadium in the starting material, VOEP, as measured by UV-visible spectroscopy; and filled diamonds represent vanadium in the reduced intermediate, VOEC. In FIG. 4 "Xs" represent a second reduced intermediate, vanadyl octaethyl tetrahydroporphyrin, as measured by UV-vis spectroscopy. These figures show the demetallation versus time behavior of three different cell designs including the production of hydrogenated metalloporphyrin intermediates which are detected by UV-visible spectroscopy. The vanadium content of the organic phase is monitored by electron paramagnetic resonance spectroscopy (EPR).

FIG. 2 is the result obtained with an undivided, packed zinc shot cathode system. This is intended as representative of an undivided three dimensional electrode. The decrease of vanadium content of the organic phase follows the drop in the concentration of the model petroporphyrin, vanadyl octaethylporphyrin (VOEP). A small concentration of a reduced intermediate, the dihydroporphyrin, vanadyl octaethylchlorin (VOEC), is produced. Samples removed from the cell did not change color on exposure to air, indicating little concentration of other more reduced, air-sensitive species.

FIG. 3 is the result obtained with the divided cell version of the cell in FIG. 2 but in which the cathode and anode were separated by an ionpermeable membrane. In this system, the solution undergoing reduction (catholyte) was not exposed to the anode. Comparison of the divided cell in FIG. 3 and undivided cell in FIG. 2 indicated that the divided cell samples removed for analysis contained significant quantifies of air-sensitive species, such as petroporphyrin anions, which revert to more stable species on exposure to air. This is reflected in the higher observed VOEC concentration.

FIG. 4 is the result obtained with the undivided cell design with expanded zinc metal mesh accordion pleated sheets according to the present invention. This design produced demetallation curves similar to those observed with the divided cell design shown in FIG. 3 and demonstrates performance comparable to a "divided-cell" in an "undivided" cell. Buildup of air-sensitive intermediates was evidenced from both the color changes of samples removed from the cell, and from the observed concentrations of hydrogenated intermediates, VOEC and tetrahydrovanadyl octaethyl porphyrin (VOET).

FIG. 5A shows a top view through the electrode stack, with inlet (1) and outlet (2) for electrolyte flow. Bulk flow of electrolyte is parallel to the folds or pleats of the cathode (from inlet to outlet). Insulator/gasket (3) surrounds the electrode stack constraining crossflow (i.e., flow perpendicular to the folds in the electrode) and flowaround the electrodes.

FIG. 5B illustrates an embodiment of the invention in which the electrode stack is viewed in cross-section. It was comprised of a first plate that is a solid zinc plate (1) which was connected to and serves as a current feeder to the layers of accordion pleated metal mesh sheets (10 mil thick) of the three dimensional pleated cathode (6). A flow distributor (2) of non-conducting material such as Teflon® surrounds the cell and provided a path for introducing the electrolyte containing the reactant to be treated solution into the cell. Gaskets (3) are used to provide sufficient depth to the cell to hold the three dimensional pleated cathode (6). The cathode consisted of pure expanded zinc (EXPAMET #6Zn10-3/0 from Exmet Corp.). About twenty layers filled a 4×16 cm cavity formed by the flow distributor (2) and gaskets (3) to a depth of 0.5 cm. However, the depth of the cathode can be varied by changing the number of spacers and gaskets that make up the electrolyte channel. Two layers of non-conducting, e.g., polypropylene, mesh were used to separate the zinc cathode (6) from the anode (5). The anode in this case was a Hastalloy C flat plate anode but any suitable compatible anode may be used. The solution to be electrolyzed was introduced into the cell by suitable means, e.g., via ports in the cell feeding the flow distributor (2). The solution can be passed through the cell, out through the flow distributor (2) and into a recirculation vessel, (not shown) where it is stirred and pumped through the cell in a batch recycle mode. Samples to be analyzed were removed from the recirculation vessel by pipette.

What is claimed is:

1. A working electrode for use in an undivided electrochemical cell, comprising:

at least one three dimensional accordion pleated sheet member having an open surface area of from zero to 50%.

2. The electrode of claim 1 wherein the sheet member is metal.

3. The electrode of claim 1 wherein the working electrode is zinc.

4. The electrode of claim 1 wherein the sheet member is porous.

5. The electrode of claim 1 wherein the sheet member is selected from the group consisting of, solid sheets, expanded mesh, woven wire cloth and hole-punched plates.

6. An undivided electrochemical cell, comprising:

a counterelectrode;

a current feeding means;

a working electrode composed of at least one three dimensional accordion folded sheet member having an open surface area of from zero to 50%, said sheet member connected to the current feeding means, and disposed between the counterelectrode and the current feeding means;

an insulating housing surrounding the counterelectrode, current feeding means and working electrode and providing restriction of electrolyte flow perpendicular to the folds in the sheet member;

means for circulating electrolyte through the cell in a direction substantially parallel to the direction of the folds in the sheet member.

7. A method for electrochemically treating metals containing hydrocarbon stream in an undivided electrochemical cell, comprising contacting metals containing hydrocarbon stream with the electrode of claim 1.

8. The method of claim 7 wherein the metals are hydrocarbon soluble species.

9. The method of claim 7 wherein the metals are selected from the group consisting of nickel and vanadium.

* * * * *